US011454199B2

(12) United States Patent
Rafaeli

(10) Patent No.: US 11,454,199 B2
(45) Date of Patent: Sep. 27, 2022

(54) ROTATABLE VALVE ASSEMBLY FOR CYLINDER HEAD OF INTERNAL COMBUSTION ENGINE

(71) Applicant: Yacob Rafaeli, Bat Yam (IL)

(72) Inventor: Yacob Rafaeli, Bat Yam (IL)

( * ) Notice: Subject to any disclaimer, the term of this patent is extended or adjusted under 35 U.S.C. 154(b) by 0 days.

(21) Appl. No.: 16/766,750

(22) PCT Filed: Nov. 25, 2018

(86) PCT No.: PCT/IL2018/051278
§ 371 (c)(1),
(2) Date: May 26, 2020

(87) PCT Pub. No.: WO2019/102475
PCT Pub. Date: May 31, 2019

(65) Prior Publication Data

US 2020/0325860 A1 Oct. 15, 2020

(30) Foreign Application Priority Data

Nov. 26, 2017 (IL) ..... 255916

(51) Int. Cl.
*F02M 26/70* (2016.01)
*F02M 35/10* (2006.01)

(52) U.S. Cl.
CPC ..... *F02M 26/70* (2016.02); *F02M 35/10255* (2013.01)

(58) Field of Classification Search
CPC .. F02M 26/70; F02M 35/10255; Y02T 10/12; F02B 31/00; F02B 31/06
See application file for complete search history.

(56) References Cited

U.S. PATENT DOCUMENTS 1,639,217 A 8/1927 Frederick
3,299,869 A 1/1967 Sicklesteel
(Continued)

FOREIGN PATENT DOCUMENTS

CN 1724855 1/2006
CN 101387221 3/2009
(Continued)

OTHER PUBLICATIONS

International Search Report of Application No. PCT/IL2018/051278 dated Mar. 21, 2019.
(Continued)

*Primary Examiner* — Joseph J Dallo
(74) *Attorney, Agent, or Firm* — Pearl Cohen Zedek Latzer Baratz LLP

(57) ABSTRACT

Generally, a rotatable valve assembly operative in an internal combustion engine is provided. The rotatable valve assembly may comprise a valve body rotatably supported in the cylinder head. The valve body may have various shapes which may allow to maximize an effective working area of a combustion chamber head and at the same time to decrease an overall space occupied by a cylinder head of the engine. The rotatable valve assembly may directly utilize an engine's camshaft rotational motion to drive the rotational motion of the valve body, thereby eliminating a need in dedicated mechanisms that convert the camshafts rotational motion into linear translational motion typically utilized in current cylinder heads. Finally, rotational motion of the valve body may reduce a time required to reach a maximal effective working area for air-fuel mixture supply and/or gas exhaust and/or may provide a smoother and quitter engine operation.

20 Claims, 17 Drawing Sheets

(56) References Cited

U.S. PATENT DOCUMENTS

| | | | | |
|---|---|---|---|---|
| 4,106,446 | A * | 8/1978 | Yamada | F02B 19/1042 123/90.13 |
| 4,285,310 | A * | 8/1981 | Takizawa | F02M 35/108 123/308 |
| 4,736,715 | A * | 4/1988 | Larsen | F02F 7/0087 123/64 |
| 4,790,272 | A | 12/1988 | Woolenweber | |
| 6,308,677 | B1 | 10/2001 | Bohach et al. | |
| 6,412,455 | B1 * | 7/2002 | Ogiso | F02M 25/089 123/90.11 |
| 6,526,745 | B1 * | 3/2003 | Ogiso | F02D 41/123 60/285 |
| 7,162,997 | B2 | 1/2007 | Madeira | |
| 7,182,056 | B1 | 2/2007 | Czysz | |
| 2001/0006058 | A1 * | 7/2001 | Kawasaki | F02D 41/0002 123/348 |
| 2002/0014213 | A1 * | 2/2002 | Fuwa | F01L 9/04 123/90.11 |
| 2003/0056739 | A1 | 3/2003 | Stull | |
| 2004/0244740 | A1 * | 12/2004 | Nishida | F16K 31/0679 123/90.11 |
| 2005/0236597 | A1 | 10/2005 | Von Willich | |
| 2011/0265754 | A1 | 11/2011 | Elsasser | |
| 2012/0181468 | A1 | 7/2012 | Telep | |
| 2015/0275709 | A1 | 10/2015 | Hodebourg | |
| 2016/0290513 | A1 | 10/2016 | Asanuma | |
| 2017/0248103 | A1 * | 8/2017 | Nishidono | F02M 61/145 |
| 2017/0362972 | A1 * | 12/2017 | Mercier | F02P 5/06 |
| 2018/0094592 | A1 * | 4/2018 | Cho | F02D 13/0207 |

FOREIGN PATENT DOCUMENTS

| | | | | |
|---|---|---|---|---|
| CN | 104847479 | A * | 8/2015 | |
| DE | 10327868 | | 1/2005 | |
| DE | 102004021125 | | 12/2005 | |
| ER | 0369099 | | 5/1990 | |
| JP | 10159572 | A * | 6/1998 | |
| JP | 2002235545 | A * | 8/2002 | |
| KR | 20030035983 | A * | 5/2003 | G05B 13/047 |
| WO | WO-2009048115 | A1 * | 4/2009 | F16K 1/20 |

OTHER PUBLICATIONS

Supplementary European Search Report of EP Application No. 18880499 dated Nov. 19, 2021.

Office Action of Chinese Application No. 2018800877221 dated Nov. 29, 2021.

* cited by examiner 130-3a 130-3b 200-3a 200-3b

ROTATABLE VALVE ASSEMBLY FOR CYLINDER HEAD OF INTERNAL COMBUSTION ENGINE

CROSS-REFERENCE TO RELATED APPLICATIONS

This application is a National Phase Application of PCT International Application No. PCT/IL2018/051278, International Filing Date Nov. 25, 2018, entitled "Rotatable Valve Assembly for Cylinder Head of Internal Combustion Engine", published on May 31, 2019 as International Patent Application Publication No. WO 2019/102475, claiming the benefit of Israel Patent Application No. 255916, filed Nov. 26, 2017, which is incorporated herein by reference in its entirety.

FIELD OF THE INVENTION

The present invention relates to the field of valves for cylinder head of internal combustion engines, and more particularly, to rotatable valves thereof.

BACKGROUND OF THE INVENTION

Current cylinder heads for internal combustion engines typically utilize poppet valves to control an air-fuel mixture supply and gas exhaust into and from combustion chambers of the engine. Current cylinder heads typically involve complex mechanisms that convert rotational motion of a camshaft into linear translational motion of the poppet valves. Such cylinder heads involve multiple mechanical parts and thereby may occupy a significant space. For example, typical cylinder head may occupy a space that may be as twice larger as compared to a space occupied by a cylinders-block of the internal combustion engine. Such cylinder heads may significantly increase an overall space occupied by the entire engine and/or increase an overall weight of the entire engine.

Further, poppet valves known in the art should preferably have round form of valve bodies and of respective valve openings in combustion chamber heads of engine's cylinders, which in turn impose limitation on a percentage of a combustion chamber head area that may be occupied by the valves ports, which may limit the rate of in-flow/out-flow of air-fuel mixture and exhaust gases, respectively, thereby limiting a potential power output, efficiency, exhaust emissions of the engine and/or the air-fuel mixture burning efficiency.

SUMMARY OF THE INVENTION

One aspect of the present invention provides a rotatable valve assembly operative in a cylinder head of an internal combustion engine, the rotatable valve assembly comprising: a valve body mating with a valve opening in the cylinder head; a rotatable valve shaft attached to the valve body such that the rotatable valve shaft being parallel to the valve body, the rotatable shaft is rotatably supported in the cylinder head to thereby enable rotation of the rotatable valve shaft and the valve body about a predetermined rotation axis and by a predetermined rotation angle; and a valve arm attached to a rotatable valve shaft's end such that the valve arm being perpendicular to the rotatable valve shaft, the valve arm is arranged to operate the rotation of the rotatable valve shaft and the valve body.

Another aspect of the present invention provides a combustion chamber head in a cylinders' head of an internal combustion engine, the combustion chamber head comprising: at least one intake valve opening in association with corresponding at least one intake rotatable valve assembly; at least one exhaust valve opening in association with corresponding at least one exhaust rotatable valve assembly; wherein each of the at least one intake valve assembly and the at least one exhaust valve assembly comprising: a valve body mating with respective valve opening of the at least one intake port or the at least one exhaust port; a rotatable valve shaft attached to the valve body such that the rotatable valve shaft being parallel to the valve body, the rotatable shaft is rotatably supported in the cylinder head to thereby enable rotation of the rotatable valve shaft and the valve body about a predetermined rotation axis and by a predetermined rotation angle; and a valve arm attached to a rotatable valve shaft's end such that the valve arm being perpendicular to the rotatable valve shaft, the valve arm is arranged to operate the rotation of the rotatable valve shaft and the valve body.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same can be carried into effect, reference will now be made, purely by way of example, to the accompanying drawings in which like numerals designate corresponding elements or sections throughout.

In the accompanying drawings.

DETAILED DESCRIPTION OF THE INVENTION

Figure 1A:
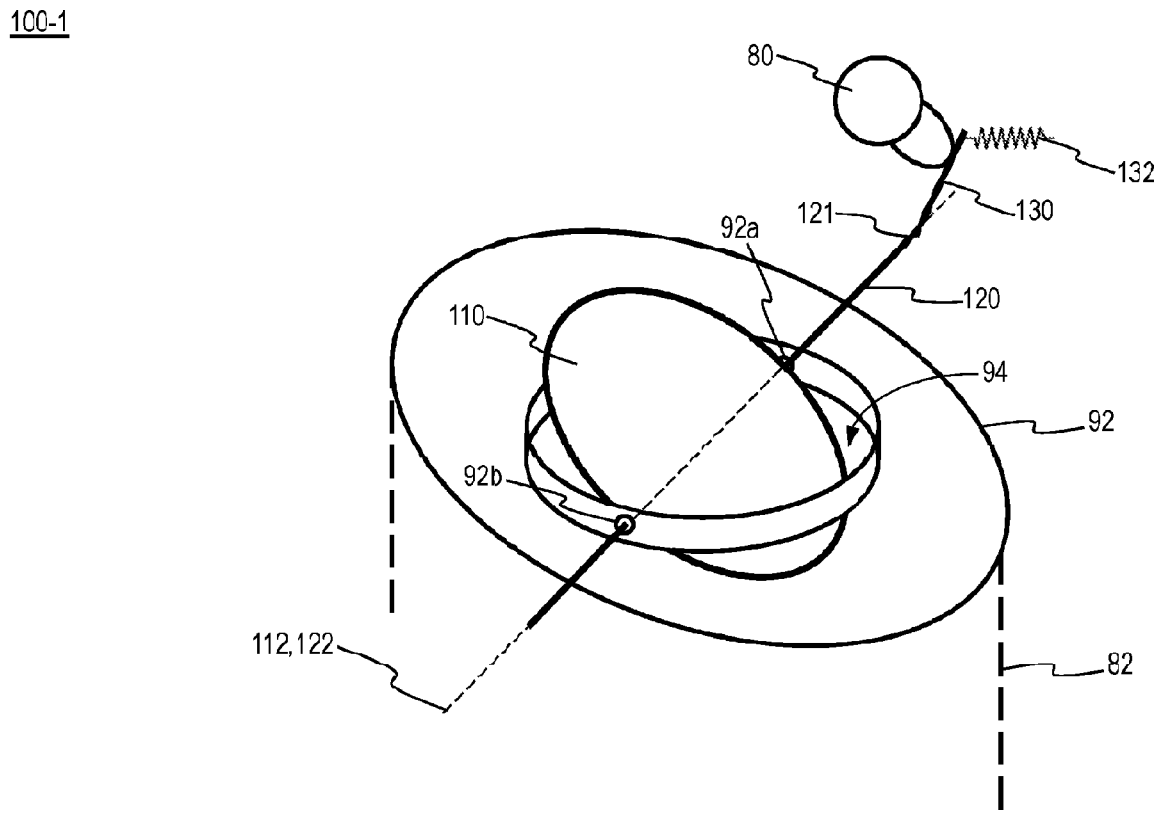
FIGS. 1A-1E are schematic illustrations of a rotatable valve assembly operative in an internal combustion engine, according to some embodiments of the invention.

Prior to the detailed description being set forth, it may be helpful to set forth definitions of certain terms that will be used hereinafter.

The term "combustion chamber head", as used in this application with respect to displayed elements, refers to a region in a cylinder head of an internal combustion engine that mates with an upper portion of a corresponding cylinder of the internal combustion engine to thereby form a corresponding combustion chamber. Typically, each combustion chamber head will comprise at least one intake valve opening and at least one exhaust valve opening.

The term "combustion chamber", as used in this application with respect to displayed elements, refers to the area inside the engine where the fuel/air mixture is compressed and then ignited.

In the following description, various aspects of the present invention are described. For purposes of explanation, specific configurations and details are set forth in order to provide a thorough understanding of the present invention. However, it will also be apparent to one skilled in the art that the present invention can be practiced without the specific details presented herein. Furthermore, well known features can have been omitted or simplified in order not to obscure the present invention. With specific reference to the drawings, it is stressed that the particulars shown are by way of example and for purposes of illustrative discussion of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention can be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments that can be practiced or carried out in various ways as well as to combinations of the disclosed embodiments. Also, it is to be understood that the phraseology and terminology employed herein is for the purpose of description and should not be regarded as limiting.

Generally, a rotatable valve assembly operative in a cylinder head of an internal combustion engine is provided. The rotatable valve assembly may comprise a valve body rotatably supported (e.g., by a rotatable shaft) in the cylinder head. The valve body may have various shapes, for example, substantially elliptic or oval shapes, which may allow to maximize an effective working area of the cylinder head (e.g., area used for air-fuel mixture supply and/or gas exhaust) and at the same time to decrease an overall space occupied by the cylinder head of the engine. The rotatable valve assembly may directly utilize an engine's camshaft rotational motion to drive the rotational motion of the valve body, thereby eliminating a need in dedicated mechanisms that convert the camshaft's rotational motion into linear translational motion typically utilized in current cylinder heads. Finally, rotational motion of the valve body may reduce a time required to reach a maximal effective working area for air-fuel mixture supply and/or gas exhaust and/or may provide a smoother and quitter engine operation.

Reference is now made to FIGS. 1A-1E, which are schematic illustrations of a rotatable valve assembly 100 operative in a cylinder head of an internal combustion engine, according to some embodiments of the invention.

Figure 1B:
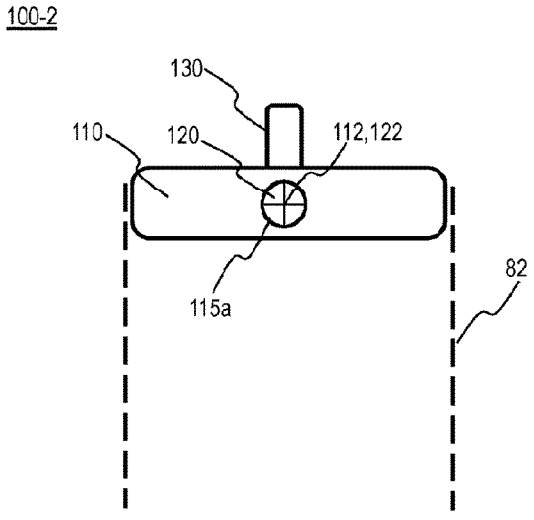
Figure 1C:
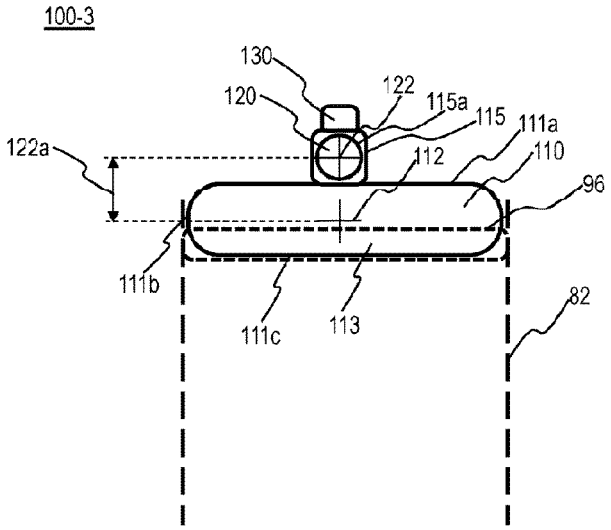
Figure 1D:
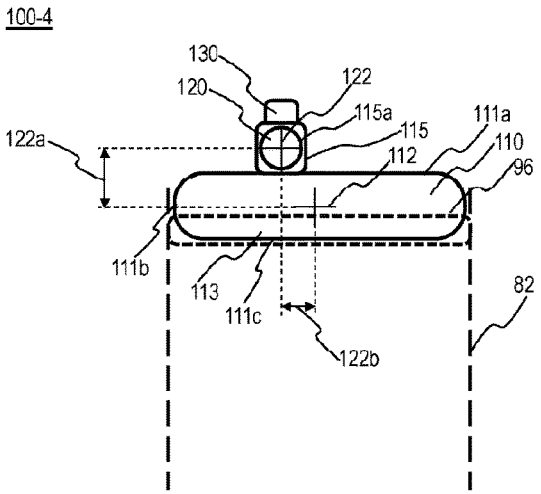
Figure 1E:
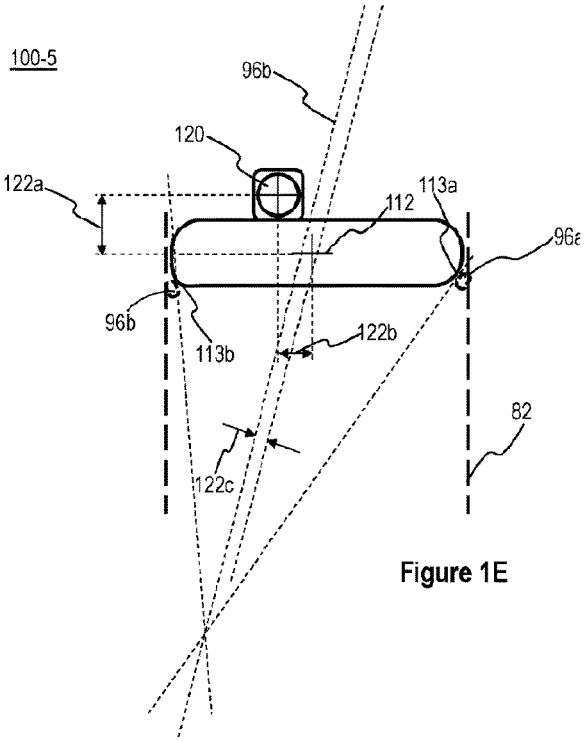

Illustration 110-1 in FIG. 1A shows a perspective view of rotatable valve assembly 100 and illustrations 110-2, 110-3, and 110-4 in FIG. 1B, FIG. 1C and FIG. 1D, respectively, show a front view of valve assembly 100. Illustration 100-5 in FIG. 1E shows a cross-sectional view of valve assembly 100.

Rotatable valve assembly 100 may comprise a valve body 110. Valve body 110 may be arranged to mate (e.g., in shape and size) with a valve opening 94 in a combustion chamber head 92. It is noted, that combustion chamber head 92 is a region in a cylinders' head that mates with an upper portion of a corresponding cylinder 82 in a cylinders' block of the internal combustion engine. Typically, each combustion chamber head 92 may comprise at least one intake valve opening and at least one exhaust valve opening. Accordingly, in various embodiments, valve opening 94 may be one of an intake valve opening or an exhaust valve opening. Valve body 110 and corresponding valve opening 94 may have various shapes, such as circle, ellipse, oval and/or rounded rectangle (e.g., as described below with respect to FIGS. 2A-2E).

Rotatable valve assembly 100 may comprise a rotatable valve shaft 120. Rotatable valve shaft 120 may be attached to valve body 110 such that rotatable valve shaft 120 being parallel to valve body 110. Rotatable valve shaft 120 may be rotatably supported in, for example, combustion chamber head 92 (e.g., the specified region in the cylinders' head) to enable rotation of rotatable valve shaft 120 and valve body 110 about a predetermined rotation axis 122. For example, combustion chamber head 92 may comprise holes **92*a*, 92*b* (e.g., as shown in FIG. 1A) or grooves 92*a*, 92*b* (e.g., as described below with respect to FIG. 4A) at opposite portions of valve opening 94. Holes (or grooves) 92*a*, 92*b* may be arranged to receive and support rotatable valve shaft 120 to thereby enable rotation of rotatable valve shaft 120 while keeping rotatable valve shaft 120 and/or valve body 110** in a desired position.

In some embodiments, predetermined rotation axis 122 may be aligned with a center-point 112 of valve body 110. For example, valve shaft 120 may pass through center-point 112 of valve body 110 (e.g., as shown in FIGS. 1A-1B).

Alternatively or complementarily, predetermined rotation axis 122 may be offset with respect to center-point 112 of valve body 110. In some embodiments, predetermined rotation axis 122 is offset in a first direction (e.g., axial direction) by a distance **122*a* with respect to center-point 112 (e.g., as shown in FIG. 1C). In some embodiments, predetermined rotation axis 122 is offset in the first direction (e.g., axial direction) by distance 122*a* and in a second direction (e.g., lateral direction) by a distance 122*b* with respect to center-point 112 (e.g., as shown in FIG. 1D). In some embodiments, predetermined rotation axis 122 is offset in the second direction (e.g., lateral direction) with respect to center-point 112** (not shown).

In some embodiments, valve body 110 comprises a tapered surface 113 (e.g., as shown in FIGS. 1C-1D). Tapered surface 113 may be achieved by, for example, tapering a junction between a lateral surface **111*b* and an anterior surface 111*c* of valve body 111. Tapered surface 113 may be arranged to mate with a valve seat surface 96 (e.g., that may also have corresponding tapered shape) in valve opening 94. Tapered surface 113 and corresponding tapered valve seat surface 96 may be arranged to enable rotation of valve body 110 having at least one offset 122*a* and/or 122*b* within valve opening 94 (e.g., as shown in FIGS. 1C-1D). Tapered surface 113 may increase a sealing area between tapered surface 113 and corresponding valve seat surface 96** in valve opening 94 (e.g., due to the tapered shape thereof). The increased sealing area may, for example, improve the sealing between the tapered surface 113 and the corresponding valve seat surface 96.

In some embodiments, valve body 110 may comprise a third offset 122*c* with respect to center-point 112. In some embodiments, tapered surface 113 and corresponding valve seat surface 96 may have a tapering angle that may vary along a valve body's 110 circumference and along a valve opening's 94 circumference, respectively (e.g., portions 96*a*, 96*b* of valve seat surface 96 and portion 113*a*, 113*b* of tapered surface 113, as shown in FIG. 1E). An axis 96*b* of a conus defined by valve seat surface 96 may be offset by a distance 122*c* with respect to center-point 112 of valve body 110 (e.g., as shown in FIG. 1E).

The offsetting of rotatable valve shaft 120 with respect to center-point 112 of valve body 110 (e.g., as shown in FIGS. 1C-1D) and, accordingly, from valve opening 94, may allow operating the rotatable valve assembly 100 under higher pressures and/or temperatures as compared to, for example, embodiments in which rotatable valve shaft 120 coincides with center-point 112 of valve body 110 (e.g., as shown in FIGS. 1A-1B). Further, offsetting of rotatable valve shaft 120 with respect to center-point 112 of valve body 110 may allow designing tapered surface 113 along at least a portion of the circumference of valve body 110, thereby improving, for example, the sealing between tapered surface 113 and the corresponding valve seat surface 96.

In some embodiments, rotatable valve shaft 120 comprises a single part (e.g., molded as a monolith unit). In some embodiments, rotatable shaft 120 comprises multiple parts. For example, rotatable shaft 120 may comprise two parts attached to opposite portions of valve body 110 and centered with respect to each other (not shown).

In some embodiments, valve body 110 and rotatable valve shaft 120 are designed (e.g., molded) as a single unit. Alternatively or complementarily, valve body 110 and rotatable valve shaft 120 are designed as separate units. In some embodiments, valve body 110 comprises a valve body shaft receiver 115 (e.g., as shown in FIGS. 1C-1D). Valve body shaft receiver 115 may be attached to, for example, a valve body's posterior surface 111*a*. Valve body shaft receiver 115 may be arranged to connect rotatable valve shaft 120 to valve body 110. In various embodiments, valve body 110 or valve body shaft receiver 115 comprises a hole 115*a* arranged to receive and support rotatable valve shaft 120 (e.g., as shown in FIG. 1B and FIGS. 1C-1D, respectively). In various embodiments, rotatable valve shaft 120 is affixed within hole 115*a* using, for example, bolts, screws, etc. (not shown).

Rotatable valve assembly 100 may comprise a valve arm 130. Valve arm 130 may be attached to, for example, a rotatable valve shaft's end 121 such that valve arm 130 being substantially perpendicular to rotatable valve shaft 120. Valve arm 130 may be arranged to operate rotation of rotatable valve shaft 120 and valve body 110 about predetermined rotation axis 122 and by a predetermined rotation angle. For example, rotation of valve arm 130 in a first direction (e.g., clockwise direction) by 90° will lead to rotation of valve body 110 by 90° in the same first direction to thereby drive valve body 110 into an open position and fully open valve opening 94. Rotation of valve arm 130 in a second direction that is opposite to the first direction (e.g., counterclockwise direction) by 90° will lead to rotation of valve body 110 by 90° in the same second direction to thereby drive valve body 110 into a closed position and fully close valve opening 94. In some embodiments, the predetermined rotation angle (e.g., angle between valve body 110 and a plane defined by valve opening 94) may range between 1° and 90°.

In some embodiments, valve arm 130 operates in a communication with a camshaft 80 of the internal combustion engine. Camshaft 80 may be arranged to operate valve arm 130 to, for example, drive valve body 110 into the open position thereof (e.g., as described above). In some embodiments, valve arm 130 comprises a spring 132. In various embodiments, spring 132 is a tension spring or a compression spring. Spring 132 may be arranged to operate valve arm 130 to drive valve body 110 into the closed position thereof (e.g., as described above).

In various embodiments, valve arm 130 operates in a communication with various hydraulic and/or electric devices arranged to control opening and/or closing of valve opening 94 by valve body 110.

In some embodiments, valve arm 130 and rotatable valve shaft 120 are designed (e.g., molded) as a single unit. Alternatively or complementarily, valve arm 130 and valve shaft 120 are designed as separate units. In some embodiments, valve shaft 130 comprises a valve arm shaft receiver 135 arranged to receive and support valve shaft's end 121 (e.g., as described below with respect to FIGS. 3A-3C). Valve shaft's end 121 may be affixed within valve body shaft receiver 135 using, for example, bolts, screws etc.

Reference is now made to FIGS. 2A-2E, which are schematic illustrations of various configurations of a rotatable valve assembly operative in an internal combustion engine, such as rotatable valve assembly 100, according to some embodiments of the invention.

Figure 2A:
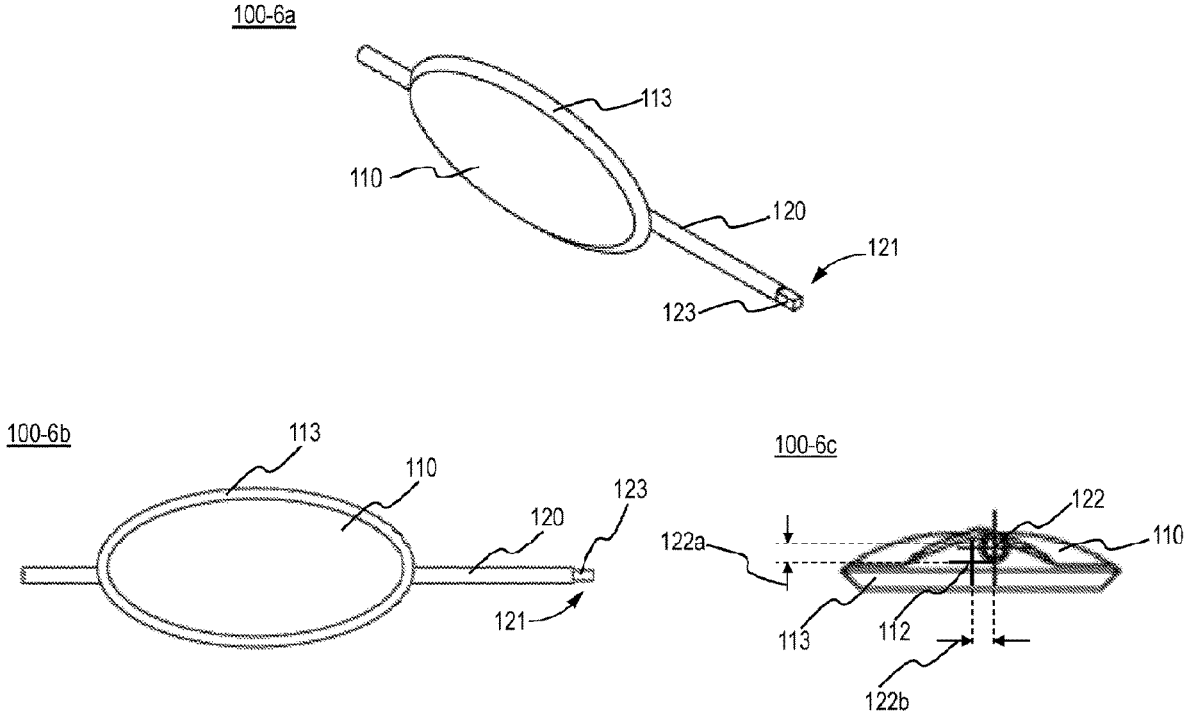
FIGS. 2A-2E are schematic illustrations of various configurations of a rotatable valve assembly operative in an internal combustion engine according to some embodiments of the invention.
Figure 2B:
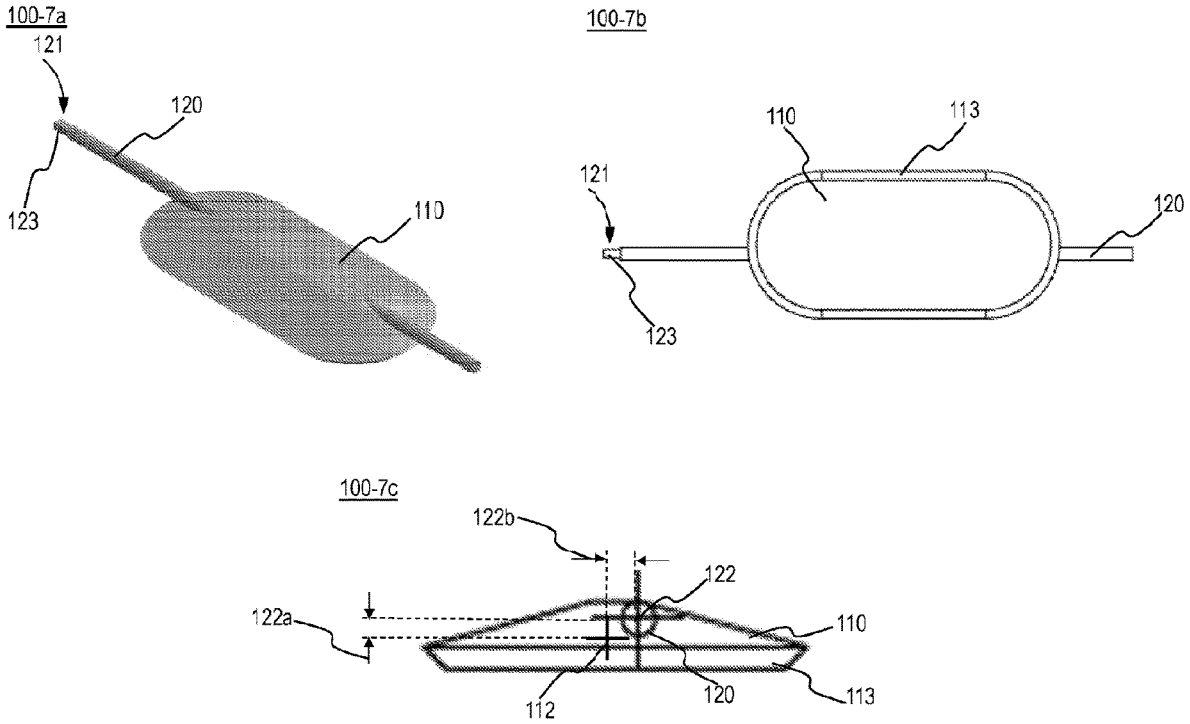
Figure 2C:
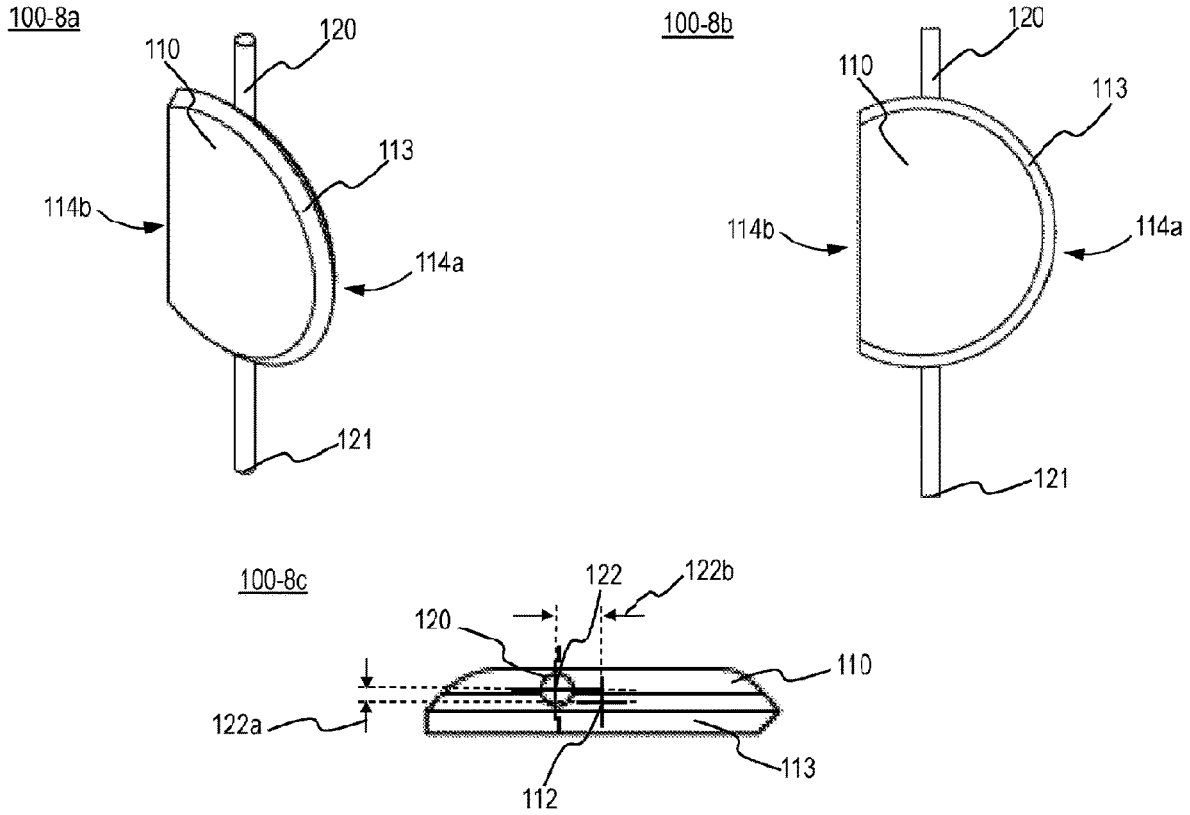
Figure 2D:
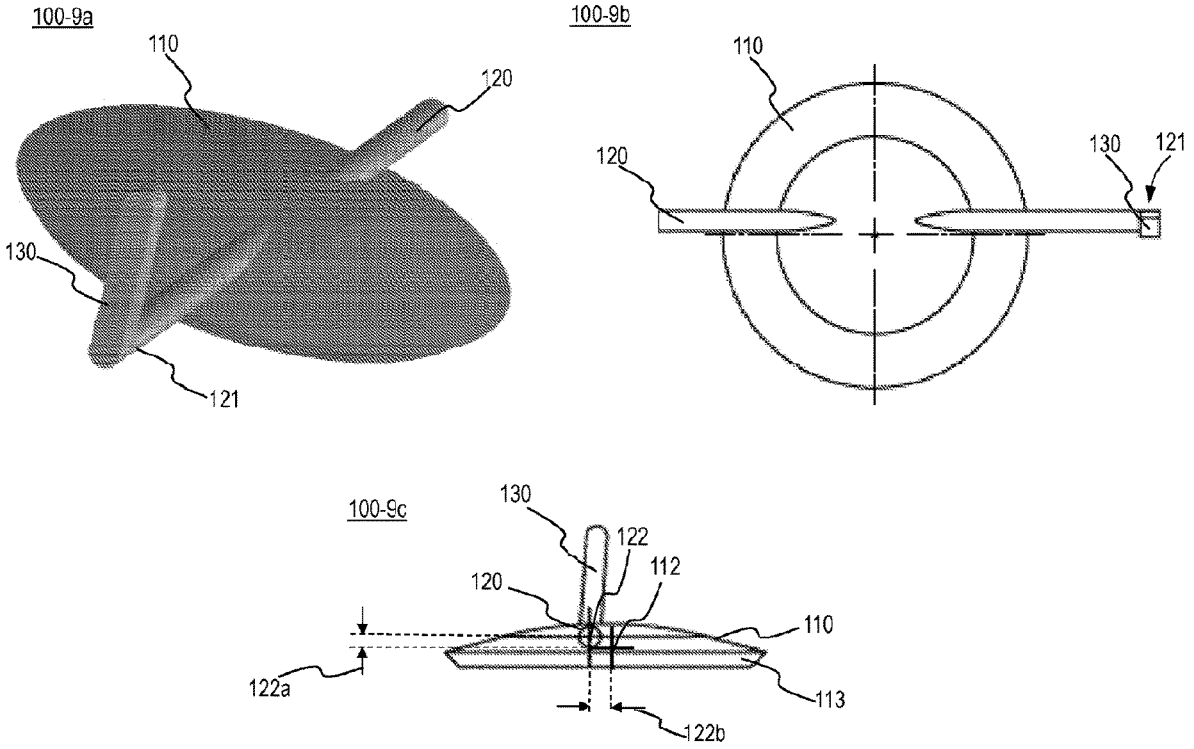
Figure 2E:
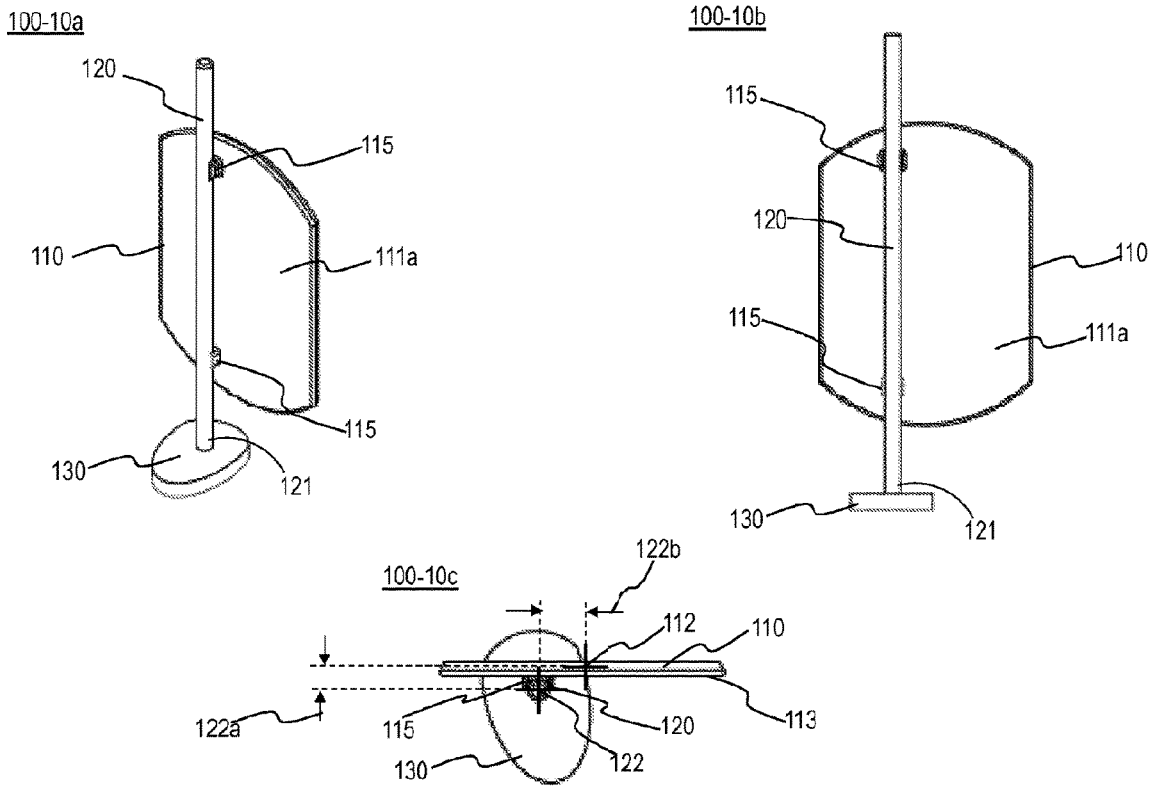

Valve body 110 of valve assembly 100 may have various shapes. For example, valve body 110 may have a substantially elliptic shape (e.g., as shown in FIG. 2A), a substantially oval shape (e.g., as shown in FIG. 2B), a substantially circular shape (e.g., as shown in FIG. 2D) and/or a substantially round rectangular shape (e.g., as shown in FIG. 2E). In some embodiments, valve body 110 has a non-symmetric shape. For example, valve body 110 may have a curved portion 114*a* and a liner portion 114*b* (e.g., as shown in FIG. 2C).

In some embodiments, tapered surface 113 occupies a whole circumference of valve body 110 (e.g., as shown in FIGS. 2A-2B and FIGS. 2D-2E). In some embodiments, tapered surface 113 occupies only a portion of valve body's 110 circumference. For example, referring to FIG. 2C, curved portion 114*a* of valve body 110 comprises tapered surface 113 while linear portion 114*b* of valve body 110 is missing the tapered surface thereof. In some embodiments, tapered surface's 113 parameters and corresponding tapered valve seat surface 96 parameters (e.g., tapering angle, tapering shape and/or location of tapered surface along the respective circumference) are designed based on the offsetting of rotatable valve shaft 120 with respect to center-point 112 of valve body 110 (e.g., as described above with respect to FIGS. 1C-1E) to thereby enable opening and closing of valve body 110, while providing sealing of the respective valve opening.

In some embodiments, rotatable valve shaft end 121 may comprise flat portions 123 (e.g., as shown in FIGS. 2A-2B). Flat portions 123 may form a specified cross-section profile of rotatable valve shaft end 121 to enable locking of rotatable valve shaft end 121 within respective valve arm shaft's receiver 135 (e.g., as described below with respect to FIGS. 3A-3C). In some embodiments, rotatable valve shaft 120 and valve arm 130 are designed as a single unit (e.g., as shown in FIGS. 2D-2E).

In some embodiments, valve body 110 and rotatable valve shaft 120 are designed as a single unit (e.g., as shown in FIGS. 2A-2D). In some embodiments, valve body 110 comprises one or more valve body shaft receiver(s) 115 (e.g., as shown in FIG. 2E). Valve body shaft receiver(s) 115 may be attached to valve body's posterior surface 111*a*. Valve body shaft receiver(s) 115 may be arranged to receive and support rotatable valve shaft 120. Rotatable valve shaft 120 may be affixed within valve body shaft receiver 115 using, for example, for example, bolts, screws, etc.

Figure 3A:
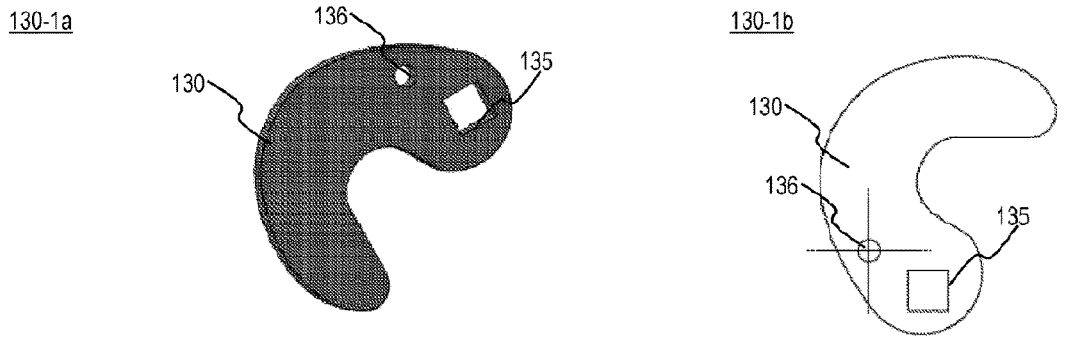
FIGS. 3A-3C are schematic illustrations of various configurations of a valve arm of a rotatable valve assembly operative in an internal combustion engine, according to some embodiments of the invention.
Figure 3B:
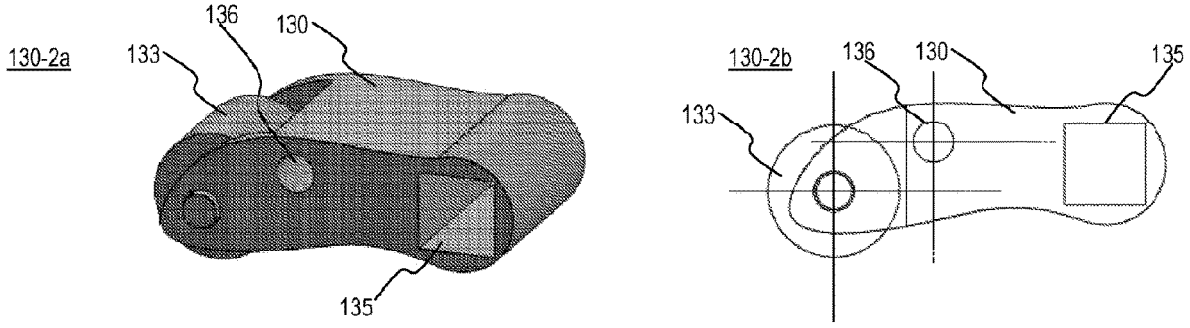
Figure 3C:
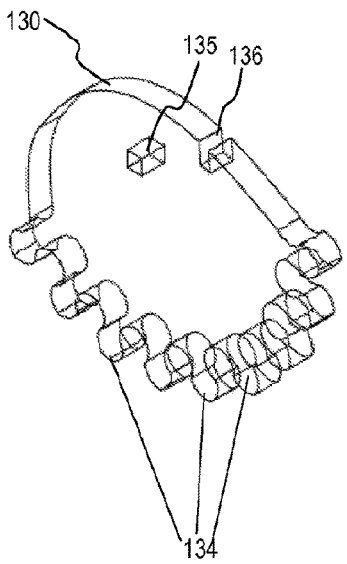
Figure 3C:
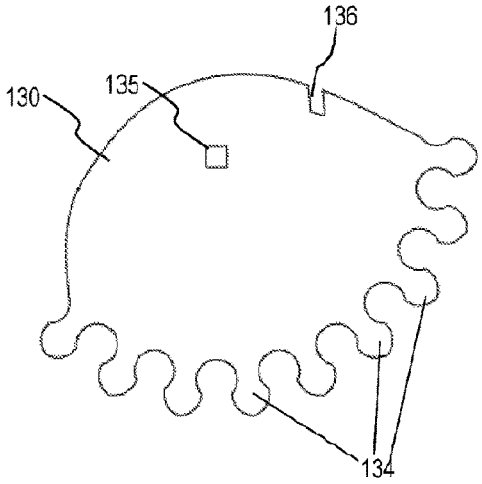

Reference is now made to FIGS. 3A-3C, which are schematic illustrations of various configurations of a valve arm, such as valve arm 130, of a rotatable valve assembly operative in an internal combustion engine, such as rotatable valve assembly 100, according to some embodiments of the invention.

Valve arm 130 may have various shapes (e.g., as shown FIGS. 2D-2E and FIGS. 3A-3C). In some embodiments, valve arm 130 has a lever-like shape (e.g., as shown in FIG. 3B and FIGS. 2D-2E). In some embodiments, valve arm 130 has a substantially C-shape (e.g., as shown in FIG. 3A). In some embodiments, valve arm 130 comprises at least one pulley 133 attached to at least one of valve arm's 130 ends. For example, valve arm 130 comprises pulley 133 attached to one of valve arm's 130 ends (e.g., as shown in FIG. 3B). In some embodiments, valve arm 130 comprises a plurality of teeth 134 protruding from a valve arm's 130 lateral surface (e.g., as shown in FIG. 3C). In general, the shape of valve arm 130 is dictated by the shape of the camshaft's lobes, and vice versa, so that valve arm 130 will be capable to operate in communication with the camshaft (e.g., as described below with respect to FIGS. 5A-5C).

Valve arm 130 may comprise a valve arm shaft receiver 135 (e.g., as shown in FIGS. 3A-3B). Valve arm shaft receiver 135 may be arranged to receive and accommodate rotatable valve shaft end 121 with a good fitting (e.g., as described above with respect to FIGS. 2A-2B). Valve shaft's end 121 may be affixed within valve body shaft receiver 135 using, for example, bolts, screws etc.

Valve arm 130 may comprise a spring connector 136 (e.g., as shown in FIGS. 3A-3B). Spring connector 136 may be arranged to connect spring 132 (e.g., tension or compression spring) to valve arm's 130 body to thereby operate valve arm 130 (e.g., as described above with respect to FIG. 1A).

Figure 4A:
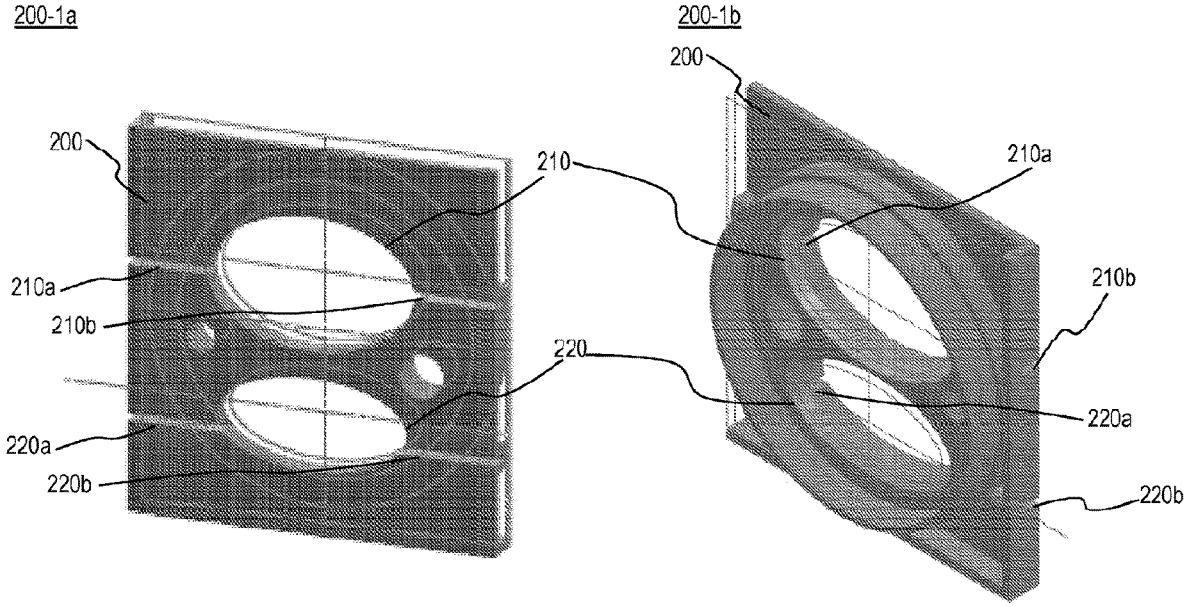
FIGS. 4A-4C are schematic illustrations of a combustion chamber head of a combustion chamber in an internal combustion engine, according to some embodiments of the invention.
Figure 4B:
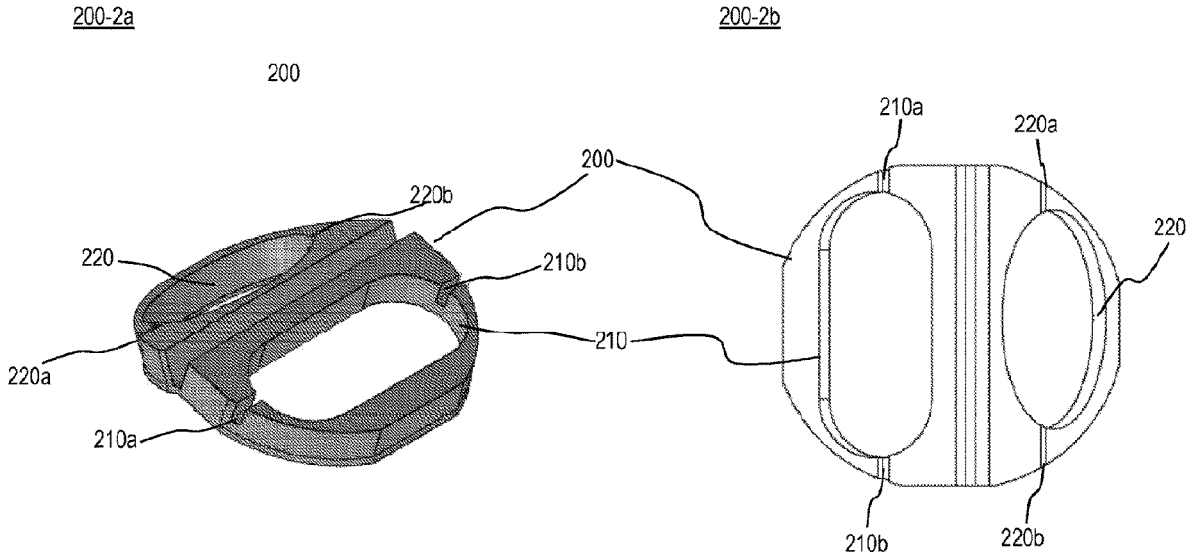
Figure 4C:
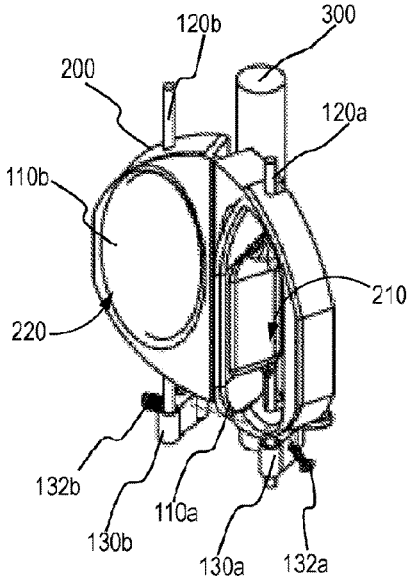
Figure 4C:
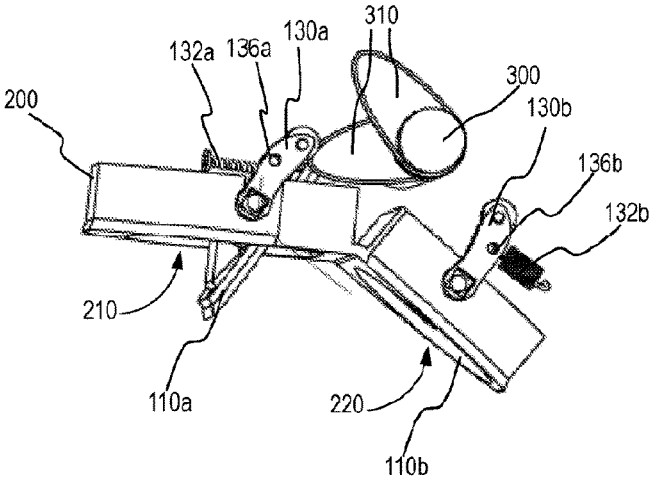

Reference is now made to FIGS. 4A-4C, which are schematic illustrations of various configurations of a combustion chamber head 200 in a cylinder head of an internal combustion engine, according to some embodiments of the invention.

Certain embodiments of the present invention may comprise a combustion chamber head 200. It is noted, that combustion chamber head 200 is a region in a cylinders' head that mates with an upper portion of a corresponding cylinder in a cylinders' block of the internal combustion engine (e.g., as described above with respect to FIG. 1A). Typically, each combustion chamber head 200 may comprise at least one intake valve opening and at least one exhaust valve opening. Accordingly, combustion chamber head 200 may be arranged to operate with at least two valve assemblies 100 that may be arranged to operate with cylinder head 200.

Combustion chamber head 200 in the cylinder's head may comprise at least one intake valve opening 210 and at least one exhaust valve opening 220. For example, FIG. 4A and FIG. 4B show combustion chamber head 200 comprising one intake port 210 and one exhaust valve opening 220. It would be apparent to those skilled in the art, that combustion chamber head 200 may comprise more than one intake valve opening 210 and more than one exhaust valve opening 220.

In various embodiments, each of intake valve opening 210 and exhaust valve opening 220 has a different shape and/or a different size. For example, both intake valve opening 210 and exhaust valve opening 220 may have an elliptic shape and different size (e.g., exhaust valve opening 220 may be smaller as compared to intake valve opening 210, for example as shown in FIG. 4A). In another example, intake valve opening 210 may have an elliptic shape and exhaust valve opening 220 may have an oval shape (e.g., as shown in FIG. 4B). Alternatively or complementarily, intake valve opening 210 and exhaust valve opening 220 may have similar shape and/or size (not shown).

In various embodiments, combustion chamber head 200 in the cylinders' head has a flat shape or a non-flat (e.g., curved) shape. For example, illustrations 200-1*a*, 200-1*b* and 200-2*a*, 200-2*b* in FIG. 4A and FIG. 4B shown flat combustion chamber head and non-flat combustion chamber head, respectively. In various embodiments, the non-flat (e.g., curved) combustion chamber head 200 may have a substantially V-shape (e.g., as shown in FIGS. 4B-4C), substantially U-shape (not shown) or any other shape known in the art. In some embodiments, non-flat combustion chamber head 200 enables increasing an effective area of valve openings (e.g., area being used for intake of air-fuel mixture and/or for gas exhaust) in the combustion head thereof, for example up to 20% as compared to flat combustion chamber head 200.

Each of intake valve opening 210 and exhaust valve opening 220 may be arranged to operate in communication with an intake valve assembly 100*a* and with an exhaust valve assembly 100*b*, respectively. In some embodiments, each of intake valve assembly 100*a* and exhaust valve assembly 100*b* is one of rotatable valve assemblies 100 (e.g., as described above with respect to FIGS. 1A-1D, FIGS. 2A-2E and/or FIGS. 3A-3C). For example, oval intake valve opening 210 may be arranged to mate with oval valve body 110*a* of intake valve assembly 100*a* (e.g., as described above with respect to FIG. 2A) and/or elliptic exhaust valve opening 220 may be arranged to mate with elliptic valve body 110*b* of exhaust valve assembly 100*b* (e.g., as described above with respect to FIG. 2B), e.g., as shown in FIG. 4C.

In some embodiments, each of intake valve opening 210 and exhaust valve opening 220 comprise grooves (or holes) 210*a*, 210*b* and grooves (or holes) 220*a*, 220*b* positioned at opposite portions of intake valve opening 210 and exhaust valve opening 220, respectively. Grooves (or holes) 210*a*, 210*b* and grooves (or holes) 220*a*, 220*b* may be arranged to receive and support rotatable valve shafts 120*a*, 120*b* of intake valve assembly 100*a* and exhaust valve assembly 100*b*, respectively (e.g., as shown in FIG. 4C and as described above with respect to FIG. 1A). In some embodiments, grooves 210*a*, 210*b* and grooves 220*a*, 220*b* comprise corresponding groove coverings (not-shown). The groove coverings may be arranged to cover grooves 210*a*, 210*b* and grooves 220*a*, 220*b* to thereby ensure desired positioning of rotatable valve shafts 120*a*, 120*b*, respectively, within combustion chamber head 200. In some embodiments, grooves (or holes) 210*a*, 210*b* and 220*a*, 220*b* may comprise bearings (not shown).

In some embodiments, valve arms 130*a*, 130*b* of intake valve assembly 100*a* and exhaust valve assembly 100*b*, respectively, operate in communication with a single camshaft 300 (e.g., as shown in FIG. 4C). Camshaft 300 may comprise camshaft lobes 310 arranged to operate valve arms

130*a*, 130*b* according to a predetermine operation pattern to drive valve bodies 110*a*, 110*b*, respectively, into the open position to thereby open intake valve opening 210 and exhaust valve opening 220, respectively. In some embodiments, each of valve arms 130*a*, 130*b* of intake valve assembly 100*a* and exhaust valve assembly 100*b*, respectively, operates in communication with a different camshaft (not shown).

In some embodiments, valve arms 130*a*, 130*b* of intake valve assembly 100*a* and exhaust valve assembly 100*b*, respectively, comprise springs 132*a*, 132*b*, respectively. Each of springs 132*a*, 132*b* may be a compression spring or a tension spring. Springs 132*a*, 132*b* may be arranged to operate valve arms 130*a*, 130*b* of intake valve assembly 100*a* and exhaust valve assembly 100*b*, respectively, to drive valve bodies 110*a*, 110*b*, respectively, into the closed position to thereby close intake valve opening 210 and exhaust valve opening 220, respectively. (e.g., as described above with respect to FIG. 1A and FIGS. 3A-3C). In various embodiments, both springs 132*a*, 132*b* are tension springs or compression springs. In various embodiments, spring 132*a* is a compression spring and spring 132*b* is a tension spring, or spring 132*b* is a compression spring and spring 132*a* is a tension spring.

Figure 4D:
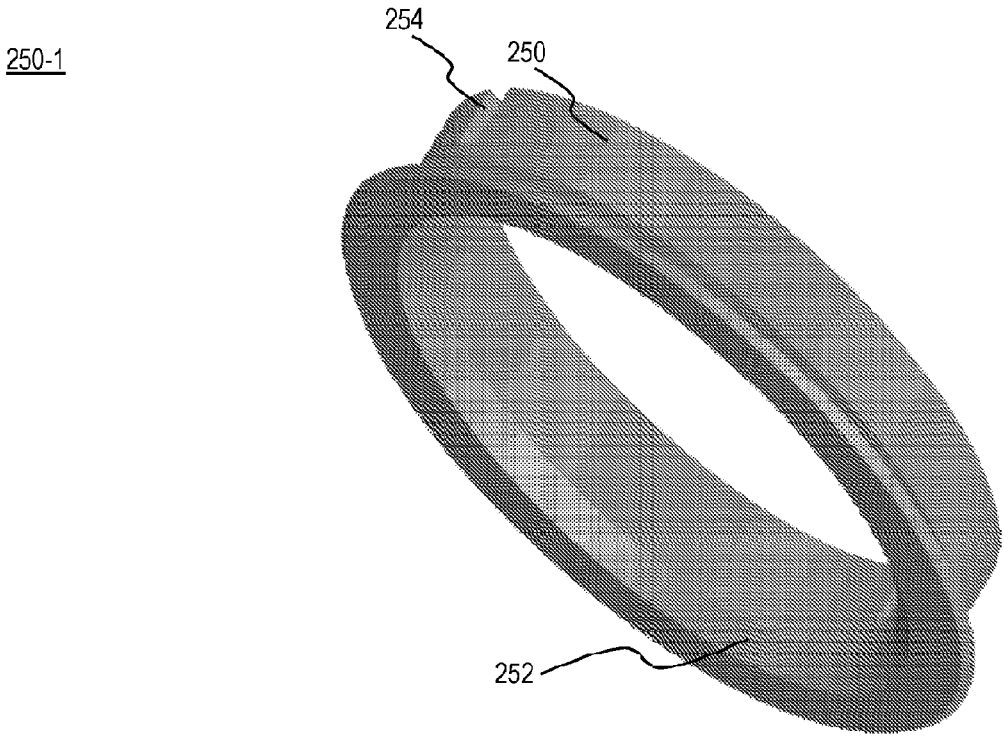
FIG. 4D is a schematic illustration of a strengthen valve seat surface for a combustion chamber head of a combustion chamber in an internal combustion engine, according to some embodiments of the invention.

Reference is now made to FIG. 4D, which is a schematic illustration of a strengthen valve seat 250 for a combustion chamber head in a cylinders' head of an internal combustion engine, such as combustion chamber head 200, according to some embodiments of the invention.

Strengthen valve seat 250 may comprise a valve seat surface 252 (e.g., similar to valve seat surface 96). In some embodiments, valve seat surface 252 may have a tapered shape (e.g., as shown in FIG. 4D). In general, the shape and size of valve seat surface 252 may be dictated by the shape and size of valve body 110 and/or by shape and size of tapered surface 113 of valve body 110 to enable good mating and sealing between the surfaces thereof.

In some embodiments, strengthen valve seat 250 comprises grooves 254 arranged to receive and support rotatable valve shaft of valve assembly (e.g., valve assembly 100), for example as described above with respect to FIGS. 4A-4C.

Figure 5A:
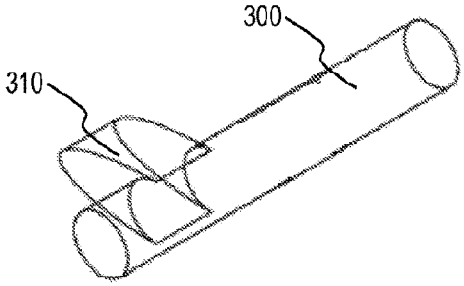
FIGS. 5A-5C are schematic illustrations of various configurations of a camshaft operative in an internal combustion engine in association with a rotatable valve assembly, according to some embodiments of the invention.
Figure 5B:
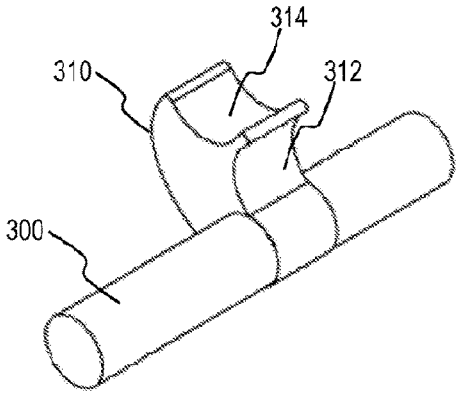
Figure 5C:
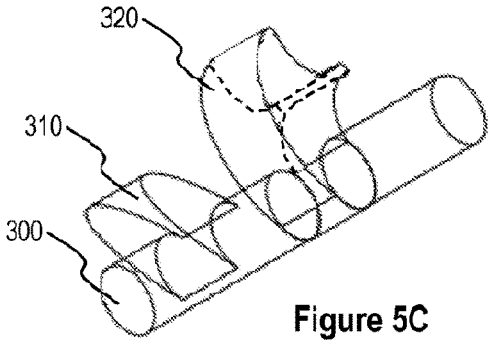

Reference is now made to FIGS. 5A-5C, which are schematic illustrations of various configurations of a camshaft 300 operative in an internal combustion engine in association with a rotatable valve assembly, such as rotatable valve assembly 100, according to some embodiments of the invention.

Camshaft 300 may comprise camshaft lobes 310 arranged to operate with valve arms 130 of valve assemblies 100 to drive valve bodies 110 into the open position to thereby open respective valve openings (e.g., intake and/or exhaust valve openings 210, 220) in combustion chamber head 200 of the combustion chamber in the internal combustion engine. It would be obvious to those skilled in the art that camshaft 300 comprises multiple camshaft lobes 310 and that FIGS. 5A-5C show one or two camshaft lobes 310 for clarity reasons only.

In general, the shape and size of each of camshaft lobes 310 is dictated by the shape and size of respective valve arm 130 (and vice versa) so that the respective valve arm 130 will be capable to operate in communication with the respective camshaft lobe 310. For example, if valve arm 130 has a lever-like shape and/or comprises a pulley 133 (e.g., as shown in FIG. 3B), respective camshaft lobe may also have a lever-like shape (e.g., as shown in FIG. 5A). In another example, if valve arm 130 comprises a plurality of teeth 134 (e.g., as shown in FIG. 3C), respective camshaft lobe 310 should also comprise corresponding teeth (not shown).

In some embodiments, camshaft lobes 310 are arranged to enable a controlled operation of valve arm 130, during driving of valve body 110 into the closed position (e.g., by spring 132). For example, respective camshaft lobe 310 may comprise a first concave surface 312 and a second concave surface 314 (e.g., as shown in FIG. 5B). The first concave surface 312 may be arranged to, for example, move respective valve arm 130 to thereby drive valve body 110 into the open position, while second concave surface 314 may be arranged to push against the respective valve arm 130 while respective valve arm 130 being driven to the closed position (e.g., by spring 132, as described above) to thereby enable controlled closing of the respective valve opening.

In some embodiments, camshaft 300 is a standard timing camshaft (e.g., as shown in FIGS. 5A-5B). In some embodiments, camshaft 300 is a variable timing camshaft (e.g., as shown in FIG. 5C). For example, camshaft 300 may comprise two lobes 310 and 320 arranged to operate single valve arm 130. Variable timing camshaft 300 may be arranged to move in a camshaft's longitudinal direction to switch between camshaft lobes 310, 320 to thereby enable variable timing operation of the respective valve arm 130.

In some embodiments, valve dynamics of rotatable valve assembly is determined based on the shape and size of respective valve arm 130, the shape and size of respective camshaft lobe 310 and/or an interaction distance between the respective valve arm 130 and the respective lobe 310 (e.g., a curved distance between a point at which the respective camshaft lobe 310 contacts the respective valve arm 130 and a point at which the respective camshaft lobe 310 separates from the respective valve arm 130). In various embodiments, the valve dynamics comprises an angular velocity of valve body 110 (and/or valve arm 130) and/or an angular acceleration of valve body 110 (and/or valve arm 130) during opening and/or closing of respective valve opening (e.g., intake and/or exhaust valve opening 210, 220, respectively) by respective valve body (e.g., valve body 110*a*, 110*b*). In various embodiments, the valve dynamics further comprises the predetermined rotation angle (e.g., angle between valve body 110 and a plane defined by the respective valve opening) at the open position, and/or the flowrate through the respective valve opening.

Certain embodiments of the present invention may comprise a cylinder head operative in an internal combustion engine. The cylinder head may comprise multiple combustion chamber heads (e.g., combustion chamber head 200, as described above with respect to FIGS. 4A-4C) operative in association with corresponding multiple rotatable valve assemblies (e.g., valve assembly 100, as described above with respect to FIGS. 1A-1D, FIGS. 2A-2E and FIGS. 3A-3C).

Figure 6A:
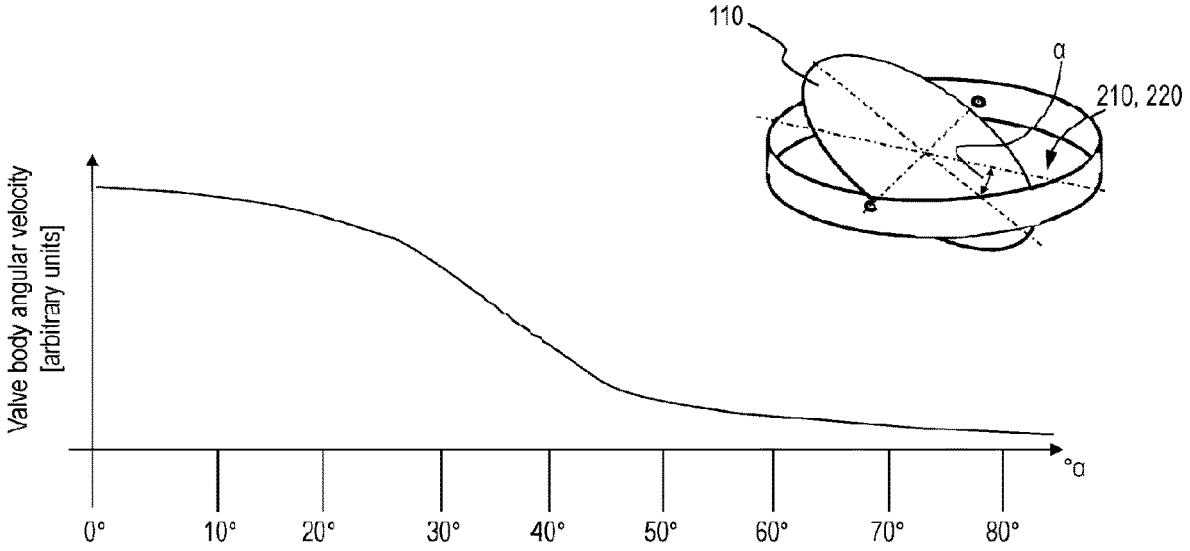
FIGS. 6A-6B are graphs showing valve dynamics of a rotatable valve assembly operative in an internal combustion engine, according to some embodiments of the invention.
Figure 6B:
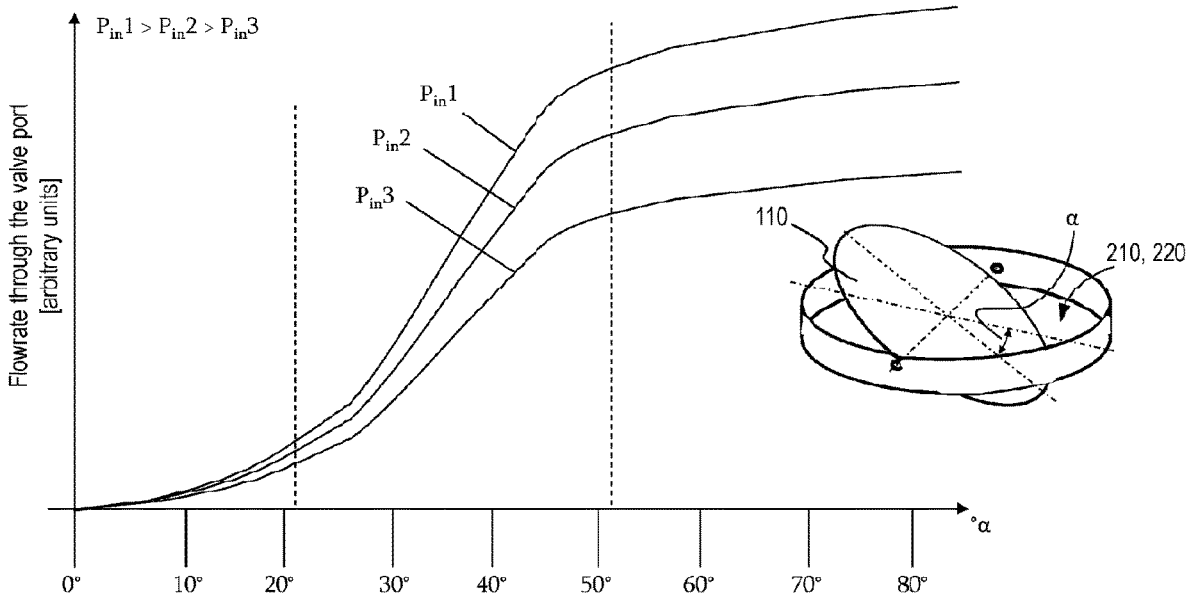

Reference is now made to FIGS. 6A-6B, which are graphs showing valve dynamics of a rotatable valve assembly operative in an internal combustion engine, such as valve assembly 100, according to some embodiments of the invention.

FIG. 6A shows a graph of the angular velocity of valve body 110 as function of a rotation angle $\alpha$ (e.g., an angle between valve body 110 and a plane defined by a respective valve opening 210, 220). FIG. 6B shows a graph of the flowrate through the respective valve opening (e.g., intake and/or exhaust valve opening 210, 220) as function of the rotation angle $\alpha$, for different pressure intake/exhaust pressure values $P_{in}1$, $P_{in}2$, $P_{in}3$, wherein $P_{in}1>P_{in}2>P_{in}3$.

It is noted that, in various embodiments, rotatable valve assembly 100 may be characterized by a non-linear relation between the angular velocity of valve body 110 and/or the flowrate through the respective valve opening (e.g., intake and/or exhaust valve opening 210, 220), and the rotation angle $\alpha$.

Advantageously, the disclosed valve assembly (e.g., rotatable valve assembly 100) and/or combustion chamber head (e.g., combustion chamber head 200) operative in an internal combustion engine may provide a desired flexibility in designing valve openings (e.g., intake and/or exhaust valve openings) and valve bodies (e.g., valve bodies 110). For example, valve openings and valve bodies may have elliptic or oval shapes (e.g., as described above with respect to FIGS. 2A-2E and FIGS. 4A-4C). Such a flexibility in selecting valve openings' and valve bodies' shapes may enable maximizing an effective working area of the cylinder head (e.g., area used for air-fuel mixture intake and/or gas exhaust) while decreasing an overall space occupied by the cylinder head. Further, the flexibility in selecting valve openings' and valve bodies' shape may enable increasing a potential power output, efficiency, exhaust emissions of the engine and/or the air-fuel mixture burning efficiency, as compared to current internal combustion engines. Moreover, the disclosed valve assembly may provide a flexibility in designing and utilizing of "dead-zones" (e.g., zones used to, for example, position spark plugs) in the cylinder head.

Advantageously, the disclosed valve assembly may utilize a rotational motion to drive the valve body between open and closed positions (e.g., as described above with respect to FIG. 1A). Accordingly, a rotational motion of an engine's camshaft may be directly used to drive the rotational motion of the valve, thereby eliminating a need in complex mechanisms that convert the camshaft's rotational motion into linear translational motion of poppet valves, typically utilized in current cylinder heads of the internal combustion engines.

Advantageously, the disclosed valve assembly and/or cylinder head may enable reducing an overall number of mechanical elements within the cylinder head and thereby reducing an overall space being occupied by the cylinder head and/or weight of the cylinder head, as compared to current cylinder heads. Moreover, utilizing rotational motion for opening the valve opening may reduce a time required to reach a maximal effective area for air-fuel mixture supply and/or gas exhaust, as compared to current linear translation poppet valves.

In the above description, an embodiment is an example or implementation of the invention. The various appearances of "one embodiment", "an embodiment", "certain embodiments" or "some embodiments" do not necessarily all refer to the same embodiments. Although various features of the invention can be described in the context of a single embodiment, the features can also be provided separately or in any suitable combination. Conversely, although the invention can be described herein in the context of separate embodiments for clarity, the invention can also be implemented in a single embodiment. Certain embodiments of the invention can include features from different embodiments disclosed above, and certain embodiments can incorporate elements from other embodiments disclosed above. The disclosure of elements of the invention in the context of a specific embodiment is not to be taken as limiting their use in the specific embodiment alone. Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described. Meanings of technical and scientific terms used herein are to be commonly understood as by one of ordinary skill in the art to which the invention belongs, unless otherwise defined. While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A cylinder head for an internal combustion engine, the cylinder head comprising:

one or more combustion chamber heads each comprising:

at least one intake valve opening in association with corresponding at least one intake rotatable valve assembly;

at least one exhaust valve opening in association with corresponding at least one exhaust rotatable valve assembly;

wherein each of the at least one intake valve assembly and the at least one exhaust valve assembly comprises:

a valve body comprising a tapered surface along at least a portion of a circumference of the valve body, the valve body is arranged to mate with a valve seat surface of a respective valve opening of one of the at least one intake valve opening and the at least one exhaust valve opening;

a rotatable valve shaft attached to the valve body such that the rotatable valve shaft being parallel to the valve body, the rotatable shaft is rotatably supported in the cylinder head to thereby enable rotation of the rotatable valve shaft and the valve body about a predetermined rotation axis and by a predetermined rotation angle; and a valve arm attached to a rotatable valve shaft's end such that the valve arm being perpendicular to the rotatable valve shaft, the valve arm is arranged to operate the rotation of the rotatable valve shaft and the valve body.

2. The cylinder head of claim 1, wherein one or more combustion chambers heads has a flat shape.

3. The cylinder head of claim 1, wherein one or more combustion chambers heads has a non-flat shape.

4. The cylinder head of claim 1, wherein the rotatable valve shaft of at least one of the at least one intake valve assembly and the at least one exhaust valve assembly passes through a center-point of the respective valve body.

5. The cylinder head of claim 1, wherein the rotatable valve shaft of at least one of the at least one intake valve assembly and the at least one exhaust valve assembly is offset with respect to a center-point of the respective valve body.

6. The cylinder head of claim 5, wherein the offset is an axial direction with respect to the center-point of the respective valve body.

7. The cylinder head of claim 5, wherein the offset is in a lateral direction with respect to the center-point of the respective valve body.

8. The cylinder head of claim 5, wherein the offset is in an axial direction and in a lateral direction with respect to the center-point of the respective valve body.

9. The cylinder head of claim 1, wherein a shape of the respective valve body of at least one of the at least one intake valve assembly and the at least one exhaust valve assembly is selected from a group consisting of: a circle, ellipse, oval and round rectangle.

10. The cylinder head of claim 1, wherein a shape of the valve body of at least one of the at least one intake valve assembly and the at least one exhaust valve assembly is asymmetric and comprises a curved portion and a linear portion.

11. The cylinder head of claim 1, wherein the valve arm of at least one of the at least one intake valve assembly and the at least one exhaust valve assembly operates in communication with a camshaft of the internal combustion engine to drive the respective valve body into at least one of an open position to thereby open the respective valve opening and closed position to thereby close the respective valve opening.

12. The cylinder head of claim 1, wherein the respective valve arm of at least one of the at least one intake valve assembly and the at least one exhaust valve assembly further comprises a spring arranged to drive the respective valve body into a closed position to thereby close the respective valve opening.

13. The cylinder head of claim 12, wherein the spring is a compression spring or a tension spring.

14. The cylinder head of claim 1, wherein at least one of the at least one intake valve assembly and the at least one exhaust valve assembly comprises a tapered surface on a junction between a valve body's lateral surface and a respective valve body's anterior surface, and wherein the tapered surface mates with a corresponding valve seat surface in the respective valve opening in the combustion chamber head.

15. The cylinder head of claim 14, wherein the tapered surface of at least one of the at least one intake valve assembly and the at least one exhaust valve assembly is along a portion of a respective valve body's circumference.

16. The cylinder head of claim 1, wherein a shape of the respective valve arm of at least one of the at least one intake valve assembly and the at least one exhaust valve assembly is selected from a group consisting of a lever-like shape, C-shape.

17. The cylinder head of claim 2, wherein the valve arm of at least one of the at least one intake valve assembly and the at least one exhaust valve assembly comprises a pulley at one of valve arm's ends.

18. The cylinder head of claim 1, wherein the valve arm of at least one of the at least one intake valve assembly and the at least one exhaust valve assembly comprises a plurality of teeth protruding from a valve arm's lateral surface.

19. The cylinder head of claim 1, wherein the shape and size of the valve arm of at least one of the at least one intake valve assembly and the at least one exhaust valve assembly is adapted to correspond to the shape and size of a respective camshaft's lobe of the internal combustion engine such that the respective valve arm is capable to operate in a communication with the respective camshaft's lobe thereof.

20. The cylinder head of claim 15, wherein the valve body of at least one of the at least one intake valve assembly and the at least one exhaust valve assembly comprises a third offset between an axis of a conus, defined by a corresponding respective valve seat surface, and the center-point of the respective valve body.

* * * * *